US006264424B1

(12) United States Patent
Fuller

(10) Patent No.: US 6,264,424 B1
(45) Date of Patent: Jul. 24, 2001

(54) RELATING TO COMPRESSORS AND TURBINES

(75) Inventor: John Fuller, Marsden (GB)

(73) Assignee: Holset Engineering Company, Ltd., Huddersfield (GB)

( * ) Notice: Subject to any disclaimer, the term of this patent is extended or adjusted under 35 U.S.C. 154(b) by 0 days.

(21) Appl. No.: 09/168,953

(22) Filed: Oct. 9, 1998

(51) Int. Cl.[7] ..... F01D 21/00
(52) U.S. Cl. ..... 415/9; 415/206
(58) Field of Search ..... 415/9, 173.4, 174.4, 415/203, 204, 206; 417/406

(56) References Cited

U.S. PATENT DOCUMENTS 3,989,407 * 11/1976 Cunningham ..... 415/9
4,944,660 * 7/1990 Joco ..... 417/407

* cited by examiner

*Primary Examiner*—Edward K. Look
*Assistant Examiner*—Richard Woo
(74) *Attorney, Agent, or Firm*—Gary M. Gron

(57) ABSTRACT

A centripetal compressor includes a compressor housing, a compressor wheel mounted within the housing and having compressor blades. The compressor housing comprises a cover plate and a diffuser flange that is fixed to both the cover plate and to a bearing housing. The diffuser member has an outer peripheral portion attached to the cover plate and a radially inner portion attached to the bearing housing. A frangible groove or weakened section is defined in the diffuser at a position intermediate the outer peripheral and the radially inner portions so as to enable predictable fracture of the diffuser flange during failure of the compressor wheel. The same principle is applied to the turbine of a turbocharger.

7 Claims, 3 Drawing Sheets

RELATING TO COMPRESSORS AND TURBINES

TECHNICAL FIELD

The present invention related to improvements in or relating to centripetal compressors and turbines particularly, but not exclusively, compressors and turbines used in turbochargers as applied to internal combustion engines.

BACKGROUND OF THE INVENTION

Turbo-chargers are generally designed to increase the inlet pressure of an internal combustion engine thereby increasing its power and efficiency. In a conventional design a centripetal compressor is driven by a centripetal turbine that is powered by the exhaust gases of the internal combustion engine.

The centripetal compressor of a turbo-charger generally comprises a compressor housing which receives a rotary compressor impeller with radially extending blades. The compressor housing comprises an annular cover, a portion of which closely follows the contours of the impeller blades and a portion of which defines an annular inlet passageway, and a diffuser flange that is fixedly connected between the annular cover and a bearing housing that retains the bearings for the compressor and the turbine. The diffuser may be fixed to the bearing housing by means of set screws or alternatively may be cast integrally with the bearing housing.

There is an ever-increasing demand for turbo-chargers of higher performance particularly with engines of high horse power for heavy duty vehicles. In order to meet this demand it has been necessary to manufacture the compressor impeller from titanium so that the compressor can withstand the high pressure ratios and arduous operating conditions. A disadvantage of an impeller made from titanium or another high density material (e.g. stainless steel) relative to the current aluminum alloy impellers is that the increased density makes the impeller more difficult to contain in the event of its failure. Failure of the compressor impeller may occur through defects in the titanium, consistent use of the turbocharger at speeds in excess of the top speed limit, or fatigue damage to the material caused by continually cycling between high and low turbo-charger speeds in extreme duty cycles. When the compressor impeller fails in use it is desirable to contain the radially projected fragments within the compressor housing to reduce the potential for damage to the turbo-charger. Generally small fragments are relatively easily contained but larger fragments tend to damage the compressor housing or diffuser flange through their force of impact. At particular risk is the connection between the diffuser flange and the bearing housing. If the two are separated oil leakage from the bearing housing can occur thereby increasing the risk of engine failure.

It is known, for experimental purposes only, or for containment verification tests, to cut a slot in a rear face of the compressor impeller to ensure that when failure occurs it splits into two parts of predictable size and mass. The compressor housing and diffuser flange can then be designed accordingly to ensure containment of the fragmented impeller. However it has still been known for the fragments to pry the compressor housing from the diffuser flange successfully. Attempts to rectify this have included the adoption of a compressor cover manufactured from spheroidal graphite iron. However, this has not proved satisfactory as this material does not absorb as much energy as desired and therefore impact loads transferred to the diffuser flange and bearing housing are greater than normal. Another known approach is to strengthen the diffuser flange in order to improve the chances of containment of the fragments but this has resulted in the impact load of the fragments being transmitted to the set screws connecting the bearing housing and the diffuser flange and caused them to shear or be otherwise torn from the bearing housing. Modifications to the design of the connection between the bearing housing and the diffuser flange to reduce the risk of it being damaged would involve significant changes to the structure of the connection design and therefore significant cost.

It is an object of the present invention to obviate or mitigate the aforesaid disadvantages.

SUMMARY OF THE INVENTION

According to the present invention there is provided a turbomachine comprising a housing, a wheel mounted within the housing and having blades, and a bearing housing; the housing comprising a cover member and a flange member that is fixed to both the cover member and the bearing housing, the flange member having an outer peripheral portion attached to the cover member and a radially inner portion attached to the bearing housing, wherein the flange member has a weakened region defined at a position intermediate the outer peripheral and the radially inner portions.

DESCRIPTION OF THE INVENTION

Figure 1:
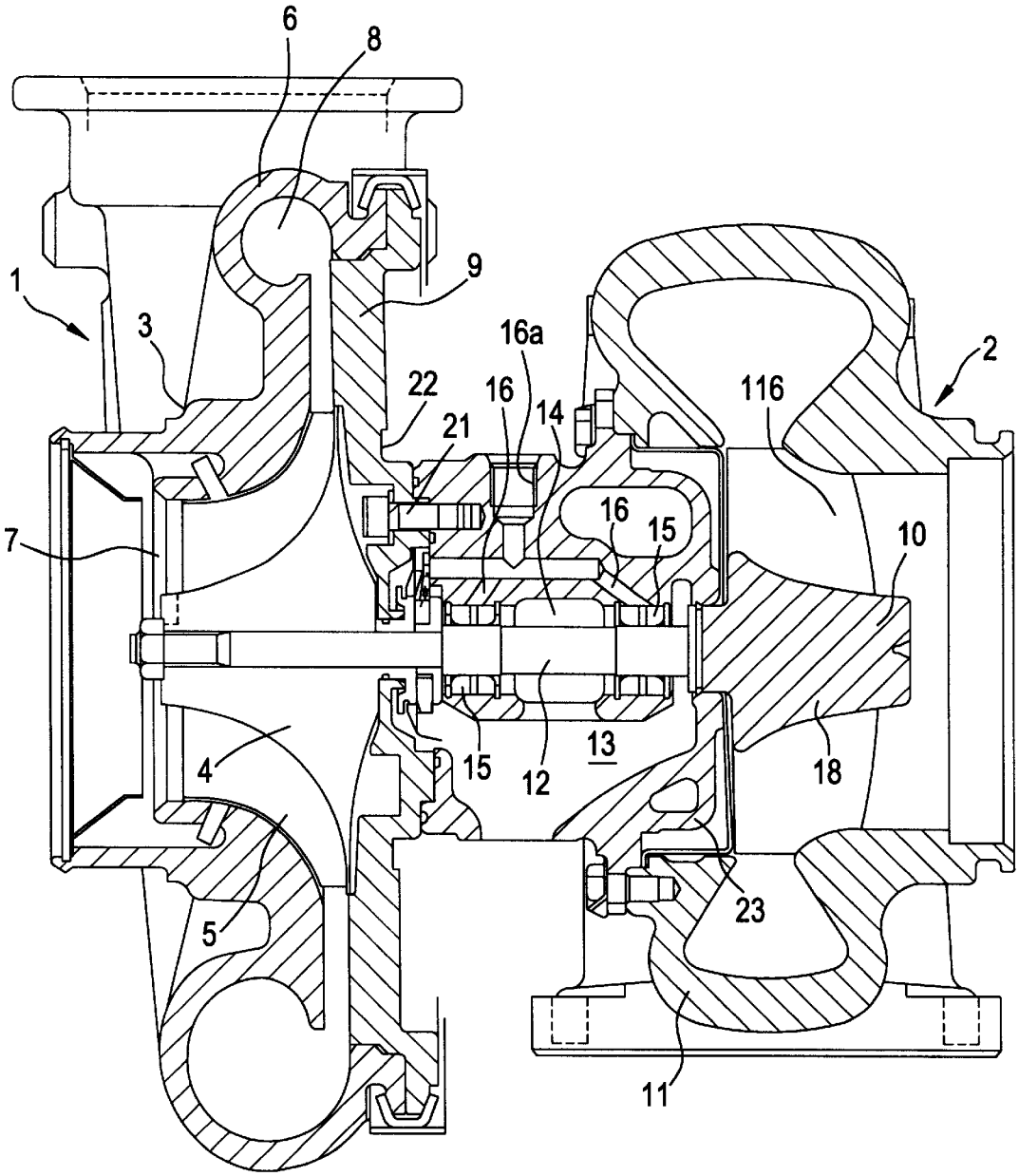
FIG. 1 shows an axial cross-section of a turbo-charger incorporating a compressor in accordance with the present invention.

Referring now to the drawings, FIG. 1 shows a turbocharger incorporating a centrifugal compressor illustrated generally by reference numeral 1 and a centripetal turbine illustrated generally by reference numeral 2.

The compressor 1 comprises a housing 3 which houses a rotatable compressor impeller 4 with radially extending impeller blades 5. The compressor housing 3 comprises an annular cover 6 that is configured so as to define an annular inlet 7 disposed around a front portion of the compressor impeller 4 and an annular outlet passageway 8 disposed adjacent the radial tips of the impeller blades 5, and a diffuser flange 9 that is disposed at the rear of the compressor impeller 4.

The turbine 2 similarly comprises a turbine wheel 10 having radial vanes 11*b* rotatably received in a turbine housing 11 and mounted on the end of a rotatable shaft 12 that is common to the compressor impeller 4. The turbine 2 is of conventional design and is not described in detail here.

Intermediate the compressor and turbine housings 3, 11 there is a bearing housing 13 with a central aperture 14 that receives the rotary shaft 12, the ends of which project into the compressor and turbine housings 3, 11 and support the compressor and turbine impellers 4,10. The bearing housing 13 contains bearings 15 that support the shaft 12 and which are lubricated via conduits indicated at 16 from an oil inlet 16*a*. Oil inlet 16*a* is connected to a suitable source of pressurized lubricant, usually an engine lubricant circuit.

Figure 3:
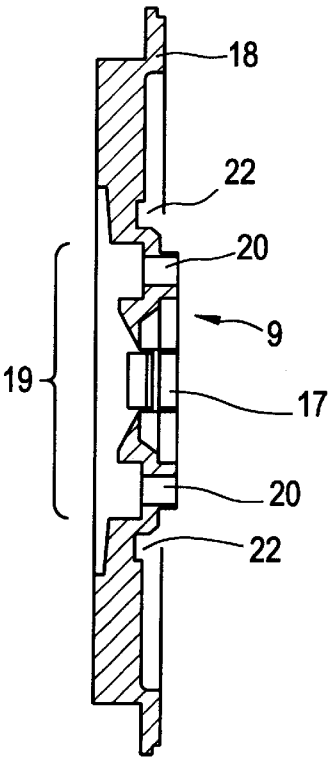
FIG. 3 shows a cross-section view, along line A—A, of the diffuser flange of FIG. 2.
Figure 2:
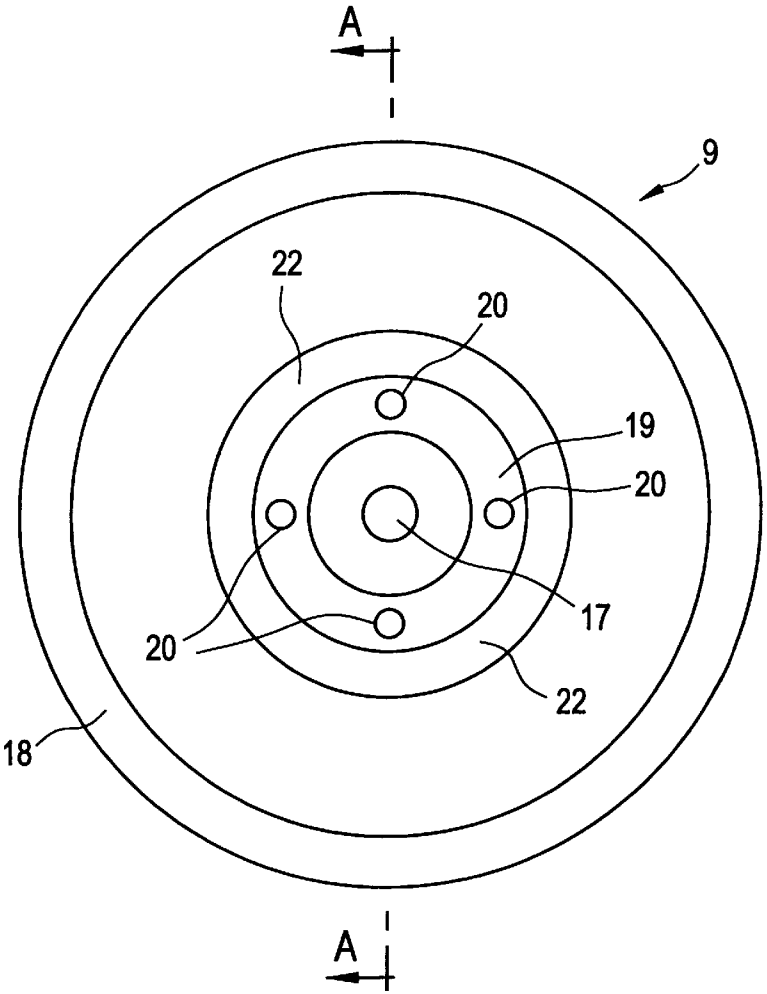
FIG. 2 shows a front view of a diffuser flange of the present invention.

The diffuser flange 9, shown in detail in FIGS. 2 and 3, is of general disc-like configuration with a central aperture 17 for receiving the rotary shaft 12. The periphery of the diffuser flange 9 has a shallow rim 18 by which the diffuser 9 is connected to the cover 6 whereas a central portion 19 of the flange 9 is relatively thick and has four equi-angularly spaced apertures 20 by which the diff-user flange 9 is fixed to the bearing housing 13 by sets-crews 21 (one only shown in FIG. 1). Immediately outboard of the set screw apertures 20 there is an annular groove 22 that significantly reduces the thickness of the diffuser flange 9 in that area.

The annular groove 22 provides a predetermined region of weakness in the diffuser flange 9 and allows the region of failure of the diffuser 9 to be predicted. Should the compressor impeller 4 fail in use, the fragments are projected radially outwards to the cover 6. The force of impact of the fragments puts strain on the cover 6, the diffuser flange 9 and the connection therebetween at the rim 18 and the first point of failure will be at the weakened groove 22 in the diffuser flange 9. This ensures that the connection between the bearing housing 13 and the diffuser flange 9 is maintained intact thereby avoiding the possibility of oil leakage. A significant portion of the diffuser flange 9 remains attached to the cover 6 and thereby provides, in combination with the cover 6, a robust container for the retention of the impeller fragments.

Figure 4:
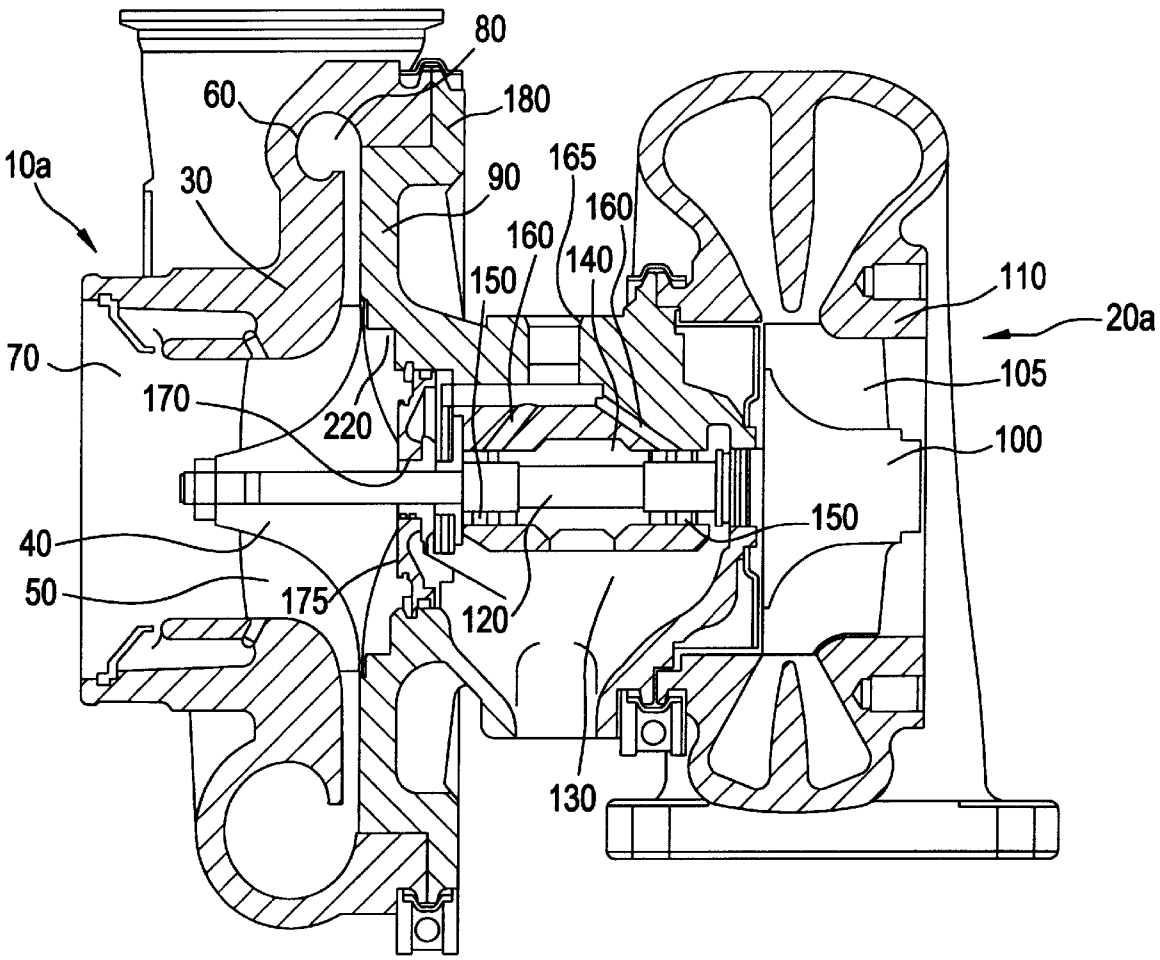
FIG. 4 shows an axial cross-section of an alternative embodiment of the turbocharger.

In an alternative embodiment shown in FIG. 4 a diffuser flange 90 is shown as being integral with a bearing housing 130 for a turbocharger incorporating a compressor 10*a* and a turbine 20*a*. The compressor 10*a* comprises a housing 30 which houses a rotatable compressor impeller 40 with radially extending impeller blades 50. The compressor housing 30 comprises an annular cover 60 that is configured so as to define an annular inlet 70 disposed around a front portion of the compressor impeller 40 and an annular outlet passageway 80 disposed adjacent the radial tips of the impeller blades 50, and a diffuser flange 90 that is disposed at the rear of the compressor impeller 40.

The turbine 20*a* similarly comprises a turbine wheel 100 having radial vanes 105 rotatably received in a turbine housing 110 and mounted on the end of a rotatable shaft 120 that is common to the compressor impeller 40. The turbine 20*a* is of conventional design and is not described in detail here.

Intermediate the compressor and turbine housings 30,110 there is a bearing housing 130 with a central aperture 140 that receives the rotary shaft 120, the ends of which project into the compressor and turbine housings 30,110 and support the compressor and turbine impellers 40,100. The bearing housing 130 contains bearings 150 that support the shaft 120 and which are lubricated via conduits indicated at 160 from an oil inlet 165. Oil inlet 165 is connected to a suitable source of pressurized lubricant, usually an engine lubricant circuit.

The diffuser flange 90 is of general disc-like configuration and is integral with bearing housing 130. An oil seal disk 175, mounted coaxially with flange 90 has a central aperture 170 for receiving the rotary shaft 120. The periphery of the diffuser flange 90 has a shallow rim 180 by which the diffuser 90 is connected to the cover 60. At about the radially innermost portion of flange 90 there is an annular groove 220 that significantly reduces the thickness of the diffuser flange 90 in that area.

The annular groove 220 provides a predetermined region of weakness in the diffuser flange 90 and allows the region of failure of the diffuser 90 to be predicted. Should the compressor impeller 40 fail in use, the fragments are projected radially outwards to the cover 60. The force of impact of the fragments puts strain on the cover 60, the diffuser flange 90 and the connection therebetween at the rim 180 and the first point of failure will be at the weakened groove 220 in the diffuser flange 90. This ensures that the portion between the bearing housing 130 and the diffuser flange 90 is maintained intact thereby avoiding the possibility of oil leakage. A significant portion of the diffuser flange 90 remains attached to the cover 60 and thereby provides, in combination with the cover 60, a robust container for the retention of the impeller fragments.

It will be appreciated that the invention is also applicable to the turbine stage of the turbo-chargers in order to prevent the bearing housing leaking oil into the exhaust and creating the risk of both fire and explosion. A groove or other weakness may be provided into a flange 25 integral with the bearing housing 13 as indicated by reference numeral 23 in FIG. 1.

It will be appreciated that numerous modifications to the above described design may be made without departing from the scope of the invention as defined in the appended claims. For example, the diffuser flange may be weakened locally in any suitable way; the annular groove described above is to be regarded as an example only. Moreover, the impeller could be constructed from any suitable material having a higher density than aluminum.

Having thus described the invention, what is novel and desired to be secured by Letters of Patent of the United States is:

1. A turbomachine comprising a housing, a hub mounted within the housing and having radially extending blades, and a bearing housing, the housing comprising a cover member and a flange member that is fixed to both the cover member and the bearing housing, the flange member having an outer peripheral portion attached to the cover member and a radially inner portion attached to the bearing housing, wherein the flange member has a weakened region defined at a position intermediate the outer peripheral and the radially inner portions, the portion of the flange member radially outward of said weakened region being free of contact with said bearing housing.

2. A turbomachine according to claim 1, wherein the weakened region is in the form of a groove.

3. A turbomachine according to claim 2, wherein the groove is annular.

4. A turbomachine according to claim 1, wherein the hub is a part of a compressor wheel and the flange member is a diffuser.

5. A turbomachine as in claim 4 wherein said compressor wheel is manufactured from titanium.

6. A turbomachine comprising a turbine housing, a turbine wheel mounted within the housing and having turbine blades, and a bearing housing, the turbine housing comprising a cover member and a flange member that is fixed to both the cover member and the bearing housing, the flange member having an outer peripheral portion attached to the cover member and a radially inner portion attached to the bearing housing, wherein the flange member has a weakened region defined at a position intermediate the outer peripheral and the radially inner portions, the portion of the flange member radially outward of said weakened region being free of contact with said bearing housing.

7. A turbomachine according to claim 6 further comprising a centripetal compressor driven by said turbine.

* * * * *